US008207071B2

(12) United States Patent
Susa et al.

(10) Patent No.: US 8,207,071 B2
(45) Date of Patent: Jun. 26, 2012

(54) VEHICULAR UPHOLSTERY POLYPROPYLENETEREPHTHALATE FIBER WOVEN FABRIC

(75) Inventors: Daisuke Susa, Wako (JP); Hidehito Fukumoto, Wako (JP); Takeko Tamura, Yasu (JP); Kazuhiro Honma, Otsu (JP)

(73) Assignees: Honda Motor Co., Ltd., Tokyo (JP); TB Kawashima Co., Ltd., Aichi (JP)

( * ) Notice: Subject to any disclaimer, the term of this patent is extended or adjusted under 35 U.S.C. 154(b) by 672 days.

(21) Appl. No.: 12/294,981

(22) PCT Filed: May 9, 2007

(86) PCT No.: PCT/JP2007/059998

§ 371 (c)(1), (2), (4) Date: Jun. 24, 2009

(87) PCT Pub. No.: WO2007/132871

PCT Pub. Date: Nov. 22, 2007

(65) Prior Publication Data

US 2010/0047538 A1 Feb. 25, 2010

(30) Foreign Application Priority Data

May 15, 2006 (JP) ..... 2006-134697

(51) Int. Cl.
*D03D 15/00* (2006.01)
*D03D 11/00* (2006.01)

(52) U.S. Cl. ..... 442/209; 442/197; 442/200; 442/203; 442/208; 442/213; 139/408; 139/420 R

(58) Field of Classification Search ..... 428/369, 428/370, 371, 373; 442/189, 197, 199, 200, 442/203, 208, 209, 213
See application file for complete search history.

(56) References Cited

U.S. PATENT DOCUMENTS 6,919,131 B2 7/2005 Koh et al.

FOREIGN PATENT DOCUMENTS

JP 11-093050 A 4/1999

(Continued)

OTHER PUBLICATIONS

Humphries, Mary. Fabric Reference. Prentice Hall, Upper Saddle River, New Jersey. 1996. pp. 109-110.*

(Continued)

*Primary Examiner* — Jenna Johnson
(74) *Attorney, Agent, or Firm* — Leason Ellis LLP.

(57) ABSTRACT

The present invention teaches a vehicular upholstery PPT-fiber fabric that is formed from a double woven fabric in which a face weaving textile design has a number of intersections, called warp up intersections where a warp yarn passes over a weft yarn, and these are more than the number of intersections, called weft up intersection, where a weft yarn passes over a warp yarn. The warp yarn is formed by twisting an intermingled yarn composed of a PPT-multi-filament yarn and a high heat shrinkable PET-multifilament yarn whose shrinkage percentage in boiling water is more than 15%. An intermingle ratio of the PPT-multifilament yarn of the warp yarn is more than the intermingle ratio of the PET-multifilament yarn of the warp yarn. In the warp yarn, the PET-multifilament yarn is shrunk by heating, so that the substantial length of the PET-multifilament yarn becomes shorter than the substantial length of the PPT-multifilament yarn. The weft yarn is composed of PPT-multifilament yarn.

9 Claims, 2 Drawing Sheets

FOREIGN PATENT DOCUMENTS

| | | | |
|---|---|---|---|
| JP | 11-100747 | A | 4/1999 |
| JP | 2000-154457 | A | 6/2000 |
| JP | 2000-328393 | A | 11/2000 |
| JP | 2001-234441 | A | 8/2001 |
| JP | 2002-004156 | A | 1/2002 |
| JP | 2002-054034 | A | 2/2002 |
| JP | 2002-105786 | A | 4/2002 |
| JP | 2002-201548 | A | 7/2002 |
| JP | 2003-105653 | A | 4/2003 |
| JP | 2003-247136 | A | 9/2003 |
| JP | 2004-211275 | A | 7/2004 |
| JP | 2005-113279 | A | 4/2005 |
| JP | 2005-139602 | A | 6/2005 |
| JP | 2006-057192 | A | 3/2006 |

OTHER PUBLICATIONS

JP 2001-234441 A. Toray Industries. Englishe Translation. Aug. 31, 2001.*

* cited by examiner

VEHICULAR UPHOLSTERY POLYPROPYLENETEREPHTHALATE FIBER WOVEN FABRIC

CROSS-REFERENCE TO PRIOR APPLICATION

This is the U.S. National Phase Application under 35 U.S.C. §371 of International Patent Application No. PCT/JP2007/059998 filed May 9, 2007, which claims the benefit of Japanese Patent Application No. 2006-134697 filed May 15, 2006, both of them are incorporated by reference herein. The International Application was published in Japanese on Nov. 22, 2007 as WO2007/132871 al under pct article 21(2).

BACKGROUND OF THE INVENTION

1. Field of the Invention

The present invention relates to a vehicular upholstery fabric mainly composed of polypropyleneterephthalate fibers.

2. Description of the Invention

For preservation of the global environment, natural fibers such as cotton, linen, silk, wool, and the like are preferably used because these fibers do not depend on non-renewable petroleum resources.

In this regard, a polypropyleneterephthalate fiber, called "PPT-fiber", and a polylacticacid fiber are synthetic fibers that can be produced from natural plant fibers rather than from petroleum.

Japanese Patent Laid Open No. 2000-154457, Japanese Patent Laid Open No. 2002-004156, Japanese Patent Laid Open No. 2003-105653, Japanese Patent Laid Open No. 2000-328393, Japanese Patent Laid Open No. 2005-113279, and Japanese Patent Laid Open No. HEI-11-093050, disclose PPT-fiber and polylacticacid fiber that can be used for a vehicular upholstery fabric.

Since the vehicular upholstery fabric is used under severe conditions, polyethyleneterephthalate fiber is mainly used for the vehicular upholstery fabric, as natural fibers and rayon are lacking in durability. Thus, natural fibers and rayon are not desirably used for vehicular upholstery fabric.

In this regard, PPT-fibers and polylacticacid fibers are relatively new materials used for the vehicular upholstery fabric, since the chemical formula of polypropyleneterephthalate, known as "PPT", and polylacticacid are similar to the chemical formulas of polyethyleneterephthalate, known as "PET". However, polylacticacid fiber lacks in corrosion resistance since it is a type of biodegradable fiber.

Further, polylacticacid fiber lacks in the ability to absorb dyes.

Therefore, in the case of application of the polylacticacid fiber for use as a vehicular upholstery fabric, it must be chemically treated.

In this regard, in comparison to PET-fiber, the Young's Modulus of PPT-fiber is lower, the rate of elastic recovery of PPT-fiber is higher, and PPT-fiber is rich in flexibility and stretching property.

Thus, it is expected that vehicular upholstery fabric having an agreeable texture will be obtained by using PPT-fiber rather than PET-fiber.

However, in comparison to PET-fiber, PPT-fiber has less than ideal heat setting properties during interlacing treatment. And, in comparison with PET-fiber, it is difficult to make the PPT-fiber fabric bulky during the raising treatment.

Further, in comparison with PET-fiber, PPT-fiber fabric easily shrinks when heated during the dyeing and finishing treatment.

Thus, heretofore it has been difficult to produce vehicular upholstery using PPT-fiber fabric.

The object of the present invention is to make PPT-fiber practical to use in the full scale production of vehicular upholstery, despite PPT-fiber having less ideal characteristics than PET-fiber.

SUMMARY OF THE INVENTION

The vehicular upholstery PPT-fiber fabric of the present invention:

(a) is formed from a double woven fabric in which a face weaving textile design has a number (P) of intersections where a warp yarn (W) passes over a weft yarn (F); these intersections are called "warp up intersections"; and there are also a number (Q) of intersections where a weft yarn (F) passes over a warp yarn (W); these intersections are called "weft up intersections";

(b) has warp yarn (W) formed by twisting an intermingled yarn composed of a PPT-multifilament yarn and a heat shrinkable PET-multifilament yarn whose shrinkage percentage in boiling water is more than 15%, (c) has an blending ratio of the PPT-multifilament yarn of the warp yarn (W) greater than the blending ratio of the PET-multifilament yarn of the warp yarn (W);

(d) has warp yarn (W), where the PET-multifilament yarn is shrunk by heating, and the substantial length of the PET-multifilament yarn is shorter than the substantial length of the PPT-multifilament yarn;

(e) has weft yarn (F) composed of PPT-multifilament yarn;

(f) has the single fiber finenesses of the PPT-multifilament yarn and the PET-multifilament yarn composing the warp yarn (W) and the weft yarn (F), both, of less than 7 dtex; and, (g) has the basis weight of the vehicular upholstery PPT-fiber fabric from 150 g/m$^2$ to 800 g/m$^2$ (150~800 g/m$^2$).

BRIEF DESCRIPTION OF THE DRAWINGS

FIG. 2-*a* shows a view of the face weaving textile design of the simple ground portions (G).

FIG. 2-*b* shows a view of the back weaving textile design of the simple ground portions (G).

FIG. 2-*c* shows a view of the weft double weaving textile design of the simple ground portions (G).

FIG. 2-*d* shows a view of the face weaving textile design of the decorative pattern portions (D).

FIG. 2-*e* shows a view of the back weaving textile design of the decorative pattern portions (D).

FIG. 2-*f* shows a view of the weft double weaving textile design of the decorative pattern portions (D).

DESCRIPTION OF THE PREFERRED EMBODIMENTS

Figure 1:
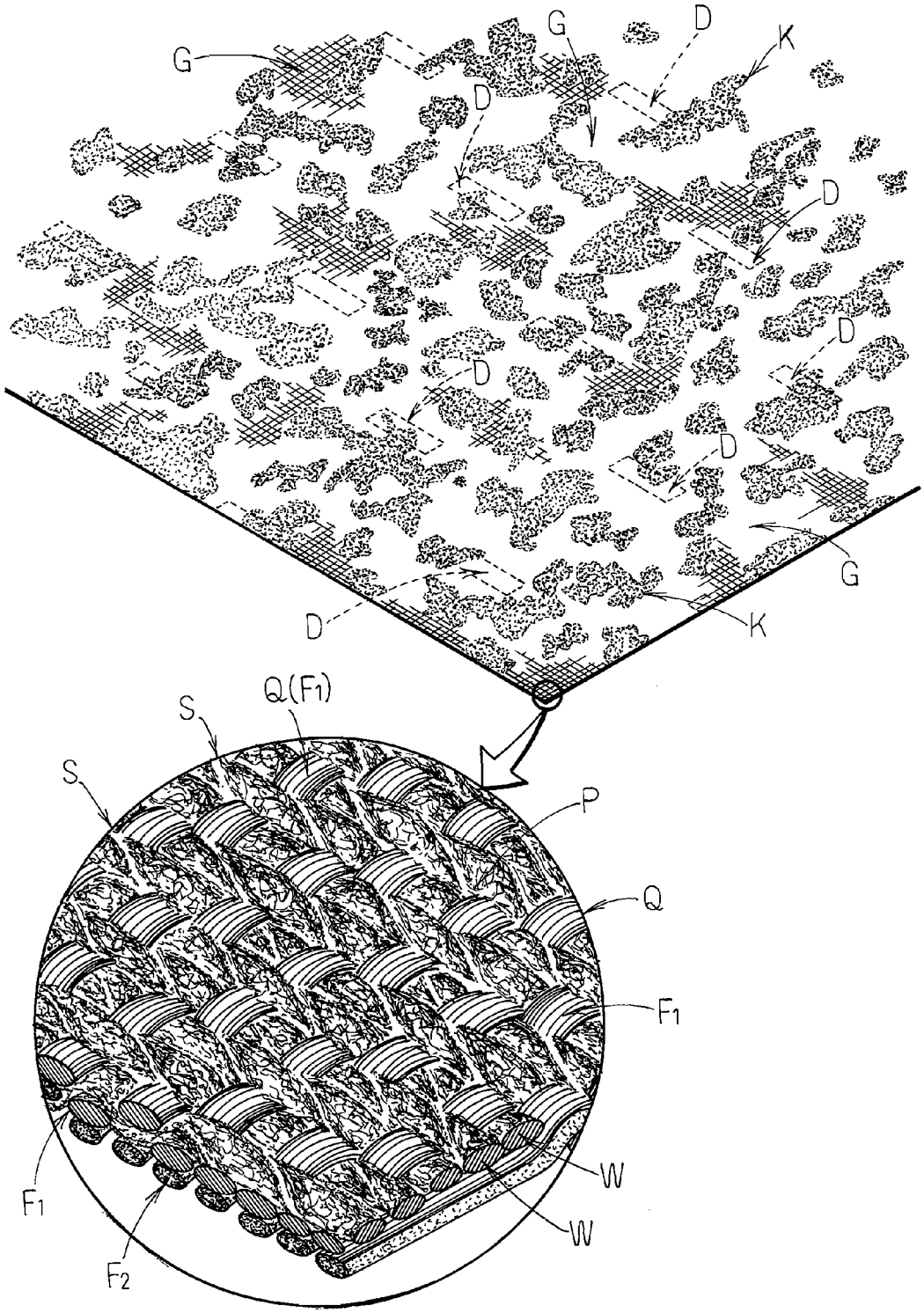
FIG. 1 shows a perspective view of the vehicular upholstery polytrimethyleneterephthalate fiber fabric of the present invention.

The vehicular upholstery PPT-fiber fabric of the present invention:

(a) is formed from a double woven fabric in which a face weaving textile design has a number (P) of intersections where a warp yarn (W) passes over a weft yarn (F) these intersections are called "warp up intersections"; and there are also a number (Q) of intersections where a weft yarn (F)

passes over a warp yarn (W) these intersections are called "weft up intersections", warp yarn (W) is formed by twisting an intermingled yarn composed of a PPT-multifilament yarn and a heat shrinkable PET-multifilament yarn whose shrinkage percentage in boiling water is more than 15%;

(c) has an intermingle ratio of the PPT-multifilament yarn of the warp yarn (W) greater than the blending ratio of the PET-multifilament yarn of the warp yarn (W);

(d) has warp yarn (W), where the PET-multifilament yarns shrunk by heating, and the substantial length of the PET-multifilament yarn is shorter than the substantial length of the PPT-multifilament yarn has weft yarn (F) composed of PPT-multifilament yarn has the single fiber finenesses of the PPT-multifilament yarn and the PET-multifilament yarn composing the warp yarn (W) and the weft yarn (F), both, of less than; and, (g) has the basis weight of the vehicular upholstery PPT-fiber fabric from 150 g/m$^2$ to 800 g/m$^2$ (150-800 g/m$^2$).

In addition, the weaving textile design of the double woven fabric is a weft double weaving textile design. The twist yarn is composed of PPT-multifilament yarn and PET-multifilament yarn, and a plurality of intermingled yarns have been twisted with the number of the twists being less than 80~250 (time/m).

A back weft yarn (F2) is a heat shrinkable PET-multifilament yarn whose shrinking rate in boiling water is greater than 15%.

In addition, the face weaving textile design is a warp satin weave.

The total fineness of the warp yarn (W) is from 150 dtex to 400 dtex.

In the warp yarn (W), the blending ratio of the PPT-multifilament yarn is from 60 weight % to 80 weight % (60~80 weight %).

The total fineness of the weft yarn (F) is from 150 dtex to 400 dtex.

The heat shrinkable PET-multifilament yarn forming the warp yarn (W) is shrunk by heating after weaving. The density of the warp is greater than the density of the weft.

In addition, the vehicular upholstery PPT-fiber fabric has been finished with a physical treatment to "shock" the fiber forming the warp yarn (W).

In addition, a pattern (D) has been woven up over the back surface of the fabric.

Further, the PPT-multifilament yarn used for the weft yarn (F) is a textured yarn, and the PPT-multifilament yarn used for the warp yarn (W) is either a non-textured or textured raw yarn.

In addition, the PPT-fiber used for the warp yarn (W) is a core-in-sheath conjugate fiber composed of a PPT-sheath component polymer and a PET-core component polymer, where the ratio of the PPT-sheath component polymer is 65~75 weight % and the ratio of the PET-core component polymer is 25~35 weight %.

In addition, the density of the warp is from 50 threads/cm to 70 threads/cm and the density of the warp is greater than the density of the weft.

When the PET-multifilament yarn forming the warp yarn (W) is shrunk by heating, the PPT-fiber becomes looser due to the substantial length of the PPT-fiber forming the warp yarn (W) and the substantial length of the PET-fiber forming the warp yarn (W).

The loosened portions of the PPT-fibers become intertwined with each other and protrude from the fine chinks between the PPT-fibers which exist between the weft up intersections (Q,Q) where the warp yarn (W) is clipped by the weft yarn (F). In this manner, even though the PPT-multifilament yarn used for the warp yarn (W) is a non-textured raw yarn, its appearance looks like a textured texturized yarn.

In accordance with the present invention, since the warp satin weave is applied as the face weaving textile design, where the number (P) of warp up intersections is more than the number (Q) of weft up intersections, the front surface of the vehicular upholstery PPT-fiber fabric is bulky and soft to the touch.

Even though the weft yarn (F) is formed from only the PPT-fiber which easily elongates, the PET-fiber which does not easily elongate acts to prevent the elongation of the PPT-fiber which is in the warp yarn (W).

Thus, the elongation in the longitudinal direction of the warp yarn is restrained.

As a result, the loosened and protruding portions of the PPT-fiber do not disappear, and the bulky and soft feeling caused by the loosened and protruding portions of the PPT-fiber is maintained.

Further, the number (P) of warp up intersections in the face weaving textile design is greater than the number (Q) of weft up intersections. Thus, the warp yarn (W) protrudes between the weft up intersections (Q and Q). This is especially the case where the weft yarn (F) is shrunk by heating and the density of the warp thus becomes greater, and the warp yarn (W) easily protrudes in adjacent warp yarns (W and W) that push each other. Therefore, the front surface of the vehicular upholstery PPT-fiber fabric becomes more bulky, rich, and soft to the touch.

As a result of the face weaving textile design being a warp satin weave that allows the warp yarn (W) to easily protrude, and allows the density of the warp to be greater than the density of the weft, the distance between adjacent weft yarns (F-F) is longer than the distance between adjacent warp yarns (W-W). Thus, the warp yarn (W) easily protrudes over the front surface of fabric, and the front surface of the vehicular upholstery PPT-fiber fabric becomes furthermore bulky, rich, and soft to the touch.

Physically treating the fiber to "shock" it (e.g., by rubbing the front surface of the fabric with a raising roll whose peripheral surface has a plurality of tufted carding needles, with an emery roll whose peripheral surface is covered with a plurality of fine protuberances, with a brush roll, or the like; or by using a beating treatment to beat the front surface of the fabric, or by using a crumpling treatment to crumple the fabric by passing it through the tumbler or the liquid flow tube of a jet dyeing apparatus, or the like) causes the loosened portions of a plurality of PPT-fibers to rise in accordance with the difference between the substantial length of PPT-fiber forming the warp yarn (W) and the substantial length of PET-fiber forming the warp yarn (W), and these loosened portions protrude irregularly and finely from the front surface of the fabric.

In this manner, the bulky and soft touch of the fabric caused by the loosened and protruding portions of the PPT-fiber is maintained.

Despite the fact that the weaving textile design, the density of the warp, the density of the weft and the like, are formed uniformly over the front surface of the double woven fabric, a clipping force of the weft yarn which acts to fix the face warp yarn (W) at the regular weft up intersection (Q) is variable on the back surface of the double woven fabric. For example, the face warp yarn (W) is not fixed by the back weft yarn (F2) at the pattern portion (D) of the double woven fabric, where the double woven fabric is divided into the face fabric and the back fabric with a full-hose warp-weft-double weaving textile design.

By comparison with the face warp yarn (W) of the simple ground portions (G), which is formed with the non-full-hose warp-weft-double weaving textile design and encloses the decorative pattern portions (D), the face warp yarn (W) of the decorative pattern portions (D) is easily swollen by the physical treatment ("shock") applied to the front surface of the double woven fabric. In this manner, the loosened portion of the PPT-fiber forming the face warp yarn (W) of the decorative pattern portions (D) easily turns into a fine fluff-like shape that protrudes over the front surface of the double woven fabric. Thus, when the pattern is woven up over the back surface of the double woven fabric by partially changing the weaving textile design, a hazy and mist-like ground pattern (K) appears over the front surface of the vehicular upholstery PPT-fiber fabric in accordance with the variation of the length of the loosened and protruded portion of the PPT-fiber of the warp yarn (W).

Therefore, the vehicular upholstery PPT-fiber fabric has a beautiful sight and a new design is obtained.

As mentioned above, the PET-fiber intermingled in the warp yarn is highly heat shrinkable.

Concurrently, the loosened portions of the PPT-fiber protrude like fine and short fluff as if they were bent and crimped textured fibers.

Therefore, the PPT-multifilament yarn may be a non-textured raw yarn.

In the event the PPT-multifilament yarn is a bulky texturized yarn, many finely and densely formed loosened portions result.

Therefore, the vehicular upholstery PPT-fiber fabric is more bulky, rich, and soft to the touch.

However, this fact does not mean that the PPT-textured multifilament yarn necessarily must be used for the vehicular upholstery fabric.

If PPT-non-textured multifilament yarn is used, a silk-like gloss appears over the surface of the fabric. This is especially the case if the pattern (D) is woven up the back surface, then the silk-like gloss becomes variable according to the visual angles, and a hazy and mist-like ground pattern (K) of the front surface appears and disappears depending on the viewing angle. Therefore, when PPT-non-textured multifilament yarn is used, vehicular upholstery PPT-fiber fabric which is rich in appearance can also be obtained.

The pattern portion (D) of the back surface is not woven for decoration of the back surface; rather, it is a way to vary the clipping force of the weft yarn which acts to fix the face warp yarn (W) at the weft up intersection (Q).

The length of the loosened and protruding portions of PPT-fiber of the warp yarn (W) partially vary in accordance with the pattern portion (D) of the back surface. The hazy mist-like ground pattern (K) appears in accordance with the partial variation of the loosened and protruding portions. Thus, the pattern portion (D) of the back surface is a way to draw the ground pattern (K) over the front surface of fabric. Therefore, a special design is not needed for the pattern (D) of the back surface. The pattern (D) may instead be simple.

The PPT-fiber is produced by polycondensation of terephthalic acid and a diol such as 1-3-propandiol, 1-2-propandiol, 1-1-propandiol, 2-2-propandiol, and the like. The PPT-fiber may be referred to as polytrimethyleneterephthalate fiber, or a "PTT-fiber". One kind of PPT-fiber is made of petroleum.

However, in view of the preservation of the global environment, it is desirable to use a PPT-fiber that can be produced from natural plant fibers rather than from petroleum; especially a PPT-fiber which is made by polycondensation of 1-3-propandiol and terephthalic acid.

The PPT-multifilament yarn can be of a single fiber fineness less than 5 dtex, and preferably 1.25 dtex~3.2 dtex, for the warp yarn (W).

A PET-multifilament yarn of a single fiber fineness of 2 dtex~10 dtex, may be used for the warp yarn (W).

In that event that both a PET-multifilament yarn and PPT-multifilament yarn are used for the warp yarn (W), it is desirable to use a single fiber fineness of PET-multifilament yarn which is thicker than the single fiber fineness of the PPT-multifilament yarn.

Also, the PET-multifilament yarn may be a non-textured raw yarn.

During the physical ("shock") treatment of the fabric, a protuberance such as a carding needle of a raising roll, a fine projection of an emery roll, a brush needle of a brush roll or the like is applied by rotation in the length direction of the warp yarn (W) in order to scratch the weft yarn (F).

In this manner, the number (P) of warp up intersections in the face weaving textile design are more than the number (Q) of weft up intersections. Thus, the number (Q) of weft up intersections of the face weaving textile design is few in number.

The weft yarn (F) does not pass over 2 threads of the warp yarn (W), and the weft yarn (F) does not protrude very much through the warp up intersections (P and P). As a result, the weft yarn (F) is hardly scratched during the physical treatment, and so is hardly napped.

On the other hand, since the warp yarn (W) is arranged in parallel with the direction of the rotation of the raising roll, the warp yarn (W) is hardly napped, as well.

However, the warp yarn (W) can become bulky since the intermingled fibers of the warp yarn (W) can become undone and then arranged in parallel with each other by the protuberance of the raising roll.

When the raising roll is used, the loosened portions of PPT-fiber forming the face warp yarn (W) cannot float out by passing over the weft up inter-section (Q).

Also, in the case of the application of the PET-multifilament twist yarn, the loosened portions of the PPT-fiber forming the face warp yarn (W) do not float out by passing over the ply streak(S). Rather, every portion of the PET-multifilament twist yarn partitioned by the weft up intersections (Q, Q, Q . . . ) are also partitioned by the ply streak (S). In this manner, the loosened portions of the PPT-fiber are partitioned by the face warp yarn (W) at the weft up intersections (Q) and the ply streak (S). Therefore, the loosened portions of the PPT-fibers do not make the appearance of the fabric seem worn, but instead make it look suede-like, because the surface of PPT-multifilament yarn is finely partitioned by the weft up intersections (Q) and the ply streak (S), and so the loosened portions of the PPT-fibers protrude finely as very short fluff.

It is desirable to make the intermingled yarn with PPT-multifilament yarn and PET-multifilament yarn in an interlaced fashion.

It is also desirable to prepare the warp yarn (W) by doubling and twisting 2~4 threads of the intermingled yarns.

In the event that number of twists of the warp yarn (W) is too great, then, during the physical ("shock") treatment, the protuberances of the raising roll can hardly bite into the warp yarn (W), and the PPT-fiber which makes up the inner portion of the warp yarn is hardly raked out.

On the other hand, if the number of twists of the warp yarn (W) is too low, then the protuberances of the raising roll can only lightly rubs PPT-fibers, and the PPT-fiber which makes up the inner portion of the warp yarn is also hardly raked out.

Further, when the number of twists of the warp yarn (W) is too low, since the ply streak (S) which partitions the warp yarn (W) in its length direction becomes low in proportion to the number of twists, the loosened portions of the PPT-fiber can easily float out. The result is that the surface of fabric looks worn in appearance.

Thus, in light of these facts, it is desirable to set the number of twists of the warp yarn (W) at about 130~170 times/m.

It is also desirable to set the single fiber fineness of the PPT-multifilament yarn used for the weft yarn (F) at equal to or somewhat thicker than the single fiber fineness of the PPT-multifilament yarn used for the warp yarn (W).

To prevent the loosened portion of the PPT-fiber of the warp yarn (W) from protruding and floating out between the weft up intersections (Q and Q), it is desirable to set the density of the weft at about 20~60 threads/cm, or looser than the density of the warp, also set at about 20~60 threads/cm.

The PET-non-bulky texturized multifilament raw yarn and the PET-bulky-texturized multifilament yarn may be used for the back weft yarn ($F_2$). If the heat shrinkable PET-multifilament yarn is used for the back weft yarn ($F_2$), the non-bulky texturized heat shrinkable PET-multifilament raw yarn should be used.

It is also desirable to apply a warp satin weave, where an irregular 4-shaft satin is included in the face of the weaving textile design, and to set the ratio of the number of the weft up intersections (Q), which are included in the face weaving textile design, at less than about 25%.

Figure 2:
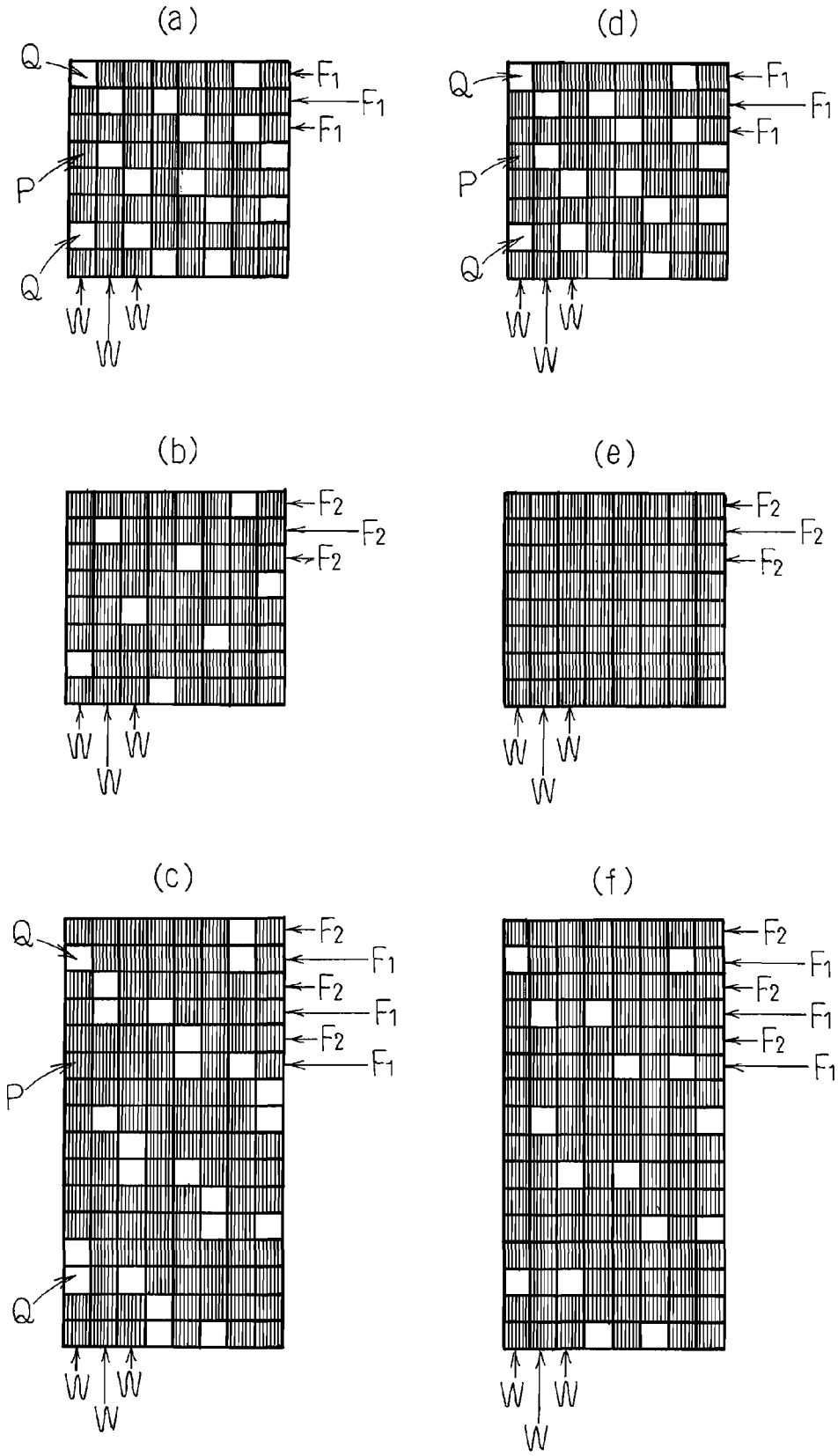
FIG. 2 shows a view of a weaving textile design of the vehicular upholstery polytrimethyleneterephthalate fiber fabric shown in FIG. 1.

FIG. 2 shows a view of a weaving textile design of the double woven fabric shown in FIG. 1. Over the back surface of the double woven fabric, the simple ground portions (G) are woven by the irregular 4-shaft satin weft double weaving textile design, and the decorative pattern portions (D) are woven by the full-hose warp-weft-double weaving textile design.

For the warp yarn (W), the intermingled yarn is prepared by interlacing the PPT-multifilament yarn with a total fineness of 84 dtex/60 f, and the high heat shrinkable PET-multifilament yarn with a total fineness of 34 dtex/12 f and a shrinking rate in boiling water of about 20%.

Three threads of the intermingled yarn are twisted in the Z-twisting direction, where the Z-shape twisting streak appears on the surface of the twist yarn, by doubling and with the number of twists at 160 times/m.

For the face weft yarn ($F_1$) and the back weft yarn ($F_2$), the PPT-bulky texturized multifilament yarn should have a total fineness is 164 dtex/2×96 f. The weft double woven fabric is woven with the warp yarn (W), the face weft yarn ($F_1$) and the back weft yarn ($F_2$), by applying the irregular 4-shaft satin as the basic textile design as shown in FIG. 2.

The speckle pattern (D) is woven over the back surface with the back weft yarn ($F_2$) by partially applying the pique weave so the back weft yarn ($F_2$) partially protrudes.

The density of the warp of the weft double woven fabric is about 50.2 threads/cm and the density of the weft is about 38.3 threads/cm.

The weft double woven fabric is heated at 130° C. by passing the fabric through a dry-heating treatment.

After a dry-heating treatment, the physical raising ("shock") treatment is applied to the front surface of the weft double woven fabric.

The density of warp of the finished fabric is about 50.2 threads/cm, the density of the weft is about 50 threads/cm, and the basis weight is about 605 g/m$^2$.

The finished fabric is used for vehicular upholstery.

The invention claimed is:

1. A vehicular upholstery polypropyleneterephthalate fiber woven fabric characterized by the following:

a vehicular upholstery polypropyleneterephthalate fiber fabric is formed from a double woven fabric in which a face weaving textile design has a number of warp up intersections where a warp yarn passes over a weft yarn, which is more than the number of weft up intersections where the weft yarn passes over the warp yarn;

the warp yarn is formed by twisting an intermingled yarn composed of a polypropyleneterephthalate multifilament yarn and a heat shrinkable polyetyhleneterephthalate multifilament yarn whose shrinkage percentage in boiling water is more than 15%;

a blending ratio of the polypropyleneterephthalate multifilament yarn of the warp yarn is more than the blending ratio of the polyetyhleneterephthalate multifilament yarn of the warp yarn;

in the warp yarn, the polyetyhleneterephthalate multifilament yarn has been shrunk by heating, and the substantial length of the polyetyhleneterephthalate multifilament yarn is shorter than the substantial length of the polypropyleneterephthalate multifilament yarn;

the weft yarn is composed of polypropyleneterephthalate multifilament yarn;

the single fiber finenesses of the polypropyleneterephthalate multifilament yarn and the polyetyhleneterephthalate multifilament yarn composing the warp and the weft yarns are respectively less than 7 dtex; and the basis weight of the vehicular upholstery polypropyleneterephthalate fiber fabric is from 150 g/m$^2$ to 800 g/m$^2$, wherein the face weaving textile design is a warp satin weave;

the total fineness of the warp yarn is from 150 dtex to 400 dtex;

the blending ratio of the polypropyleneterephthalate multifilament yarn is from 60 weight % to 80 weight % in the warp yarn;

the total fineness of the weft yarn is from 150 dtex to 400 dtex;

the heat shrinkable polyetyhleneterephthalate multifilament yarn forming the warp yarn has been shrunk by heating after weaving; and the density of the warp is greater than the density of the weft.

2. A vehicular upholstery polypropyleneterephthalate fiber woven fabric according to claim 1, wherein:

the weaving textile design of the double woven fabric is a weft double weaving textile design;

the warp yarn contains a plurality of intermingled yarns that are twisted at less than 80~250 (times/m), said intermingled yarn being composed of polypropyleneterephthalate multifilament yarn and polyetyhleneterephthalate multifilament yarn; and a back weft yarn is a heat shrinkable polyetyhleneterephthalate multifilament yarn with a shrinking rate in boiling water of more than 15%.

3. A vehicular upholstery polypropyleneterephthalate fiber woven fabric according to claim 1, wherein:

the vehicular upholstery polypropyleneterephthalate fiber fabric has been finished by a physical treatment to shock the fiber forming the warp yarn.

4. A vehicular upholstery polypropyleneterephthalate fiber woven fabric according to claim 1, wherein:

a decorative pattern has been woven over the back surface of the fabric.

5. A vehicular upholstery polypropyleneterephthalate fiber woven fabric according to claim 1, wherein:

the polypropyleneterephthalate multifilament yarn used for the weft yarn is a textured yarn.

6. A vehicular upholstery polypropyleneterephthalate fiber woven fabric according to claim 1, wherein:

the polypropyleneterephthalate multifilament yarn used for the warp yarn is a non-texture raw yarn.

7. A vehicular upholstery polypropyleneterephthalate fiber woven fabric according to claim 1, wherein:

the polypropyleneterephthalate multifilament yarn used for the warp yarn is a textured raw yarn.

8. A vehicular upholstery polypropyleneterephthalate fiber woven fabric according to claim 1, wherein:

the polypropyleneterephthalate fiber used for the warp yarn is a core-in-sheath conjugate fiber composed of polypropyleneterephthalate as a sheath component polymer and polyetyhleneterephthalate as a core component polymer, wherein the ratio of the polypropyleneterephthalate sheath component polymer is 65~75 weight percent and the ratio of the polyetyhleneterephthalate core component polymer is 25~35 weight percent.

9. A vehicular upholstery polypropyleneterephthalate fiber woven fabric according to claim 1, wherein:

the density of the warp is from 50 threads/cm to 70 threads/cm; and the density of the warp is greater than the density of the weft.

* * * * *